US008749451B1

(12) United States Patent
Zamarron et al.

(10) Patent No.: US 8,749,451 B1
(45) Date of Patent: Jun. 10, 2014

(54) REDUCED CAVITY WIDEBAND MULTI POLAR SPIRAL ANTENNA

(75) Inventors: J. Michael Zamarron, Fort Worth, TX (US); Umang R. Patel, Mansfield, TX (US); Kurt S. Schuder, Dallas, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 485 days.

(21) Appl. No.: 12/932,001

(22) Filed: Feb. 15, 2011

Related U.S. Application Data

(60) Provisional application No. 61/305,102, filed on Feb. 16, 2010, provisional application No. 61/338,353, filed on Feb. 16, 2010.

(51) Int. Cl.
*H01Q 1/36* (2006.01)

(52) U.S. Cl.
USPC ..... 343/895; 343/767; 343/821; 343/846; 343/848; 343/792.5

(58) Field of Classification Search
USPC ..... 343/895, 767, 821, 846, 848, 795, 343/792.5, 790, 789, 828, 834, 837, 806, 343/807, 792
See application file for complete search history.

(56) References Cited

U.S. PATENT DOCUMENTS

| | | | | |
|---|---|---|---|---|
| 4,086,591 | A | 4/1978 | Siwiak et al. | |
| 4,608,572 | A * | 8/1986 | Blakney et al. | 343/792.5 |
| 5,990,849 | A | 11/1999 | Salvail | |
| 6,201,513 | B1 * | 3/2001 | Ow et al. | 343/895 |
| 6,407,721 | B1 | 6/2002 | Mehen | |
| 6,664,938 | B2 | 12/2003 | Strickland | |
| 6,922,179 | B2 | 7/2005 | McCollum | |
| 7,525,509 | B1 | 4/2009 | Robinson | |
| 2003/0210205 | A1 | 11/2003 | Cencich | |

* cited by examiner

*Primary Examiner* — Douglas W Owens
*Assistant Examiner* — Jae Kim
(74) *Attorney, Agent, or Firm* — Withrow & Terranova, PLLC

(57) ABSTRACT

A wideband antenna with backlobe elimination in a confined space is disclosed. Backlobe elimination is by an array of electromagnetically conductive members disposed between the spiral element and the ground plane and almost contacting the ground plane so as to bleed a backlobe away from the spiral antenna to the ground plane. In one embodiment, the members are conical elements disposed between the spiral element and the ground plane of a spiral antenna such that the apexes of the conical elements almost contact the spiral element and the bases of the conical elements contact the ground plane. In some embodiments, other means may be employed to perform this function. In operation, conical elements bleed the backlobe of the signal away from the spiral element to the ground plane.

10 Claims, 1 Drawing Sheet

REDUCED CAVITY WIDEBAND MULTI POLAR SPIRAL ANTENNA

CROSS-REFERENCE TO RELATED APPLICATIONS

The priority of U.S. provisional application Ser. No. 61/305,102, filed Feb. 16, 2010, in the name of the inventors J. Michael Zamarron et al., and entitled "Reduced Cavity Wideband Multi Polar Spiral Antenna" is hereby claimed under 35 U.S.C. §119(e). This application is also hereby incorporated by reference for all purposes.

The priority of U.S. provisional application Ser. No. 61/338,353, filed Feb. 16, 2010, in the name of the inventors J. Michael Zamarron et al., and entitled "Reduced Cavity Wideband Multi Polar Spiral Antenna" is hereby claimed under 35 U.S.C. §119(e). This application is also hereby incorporated by reference for all purposes.

STATEMENT REGARDING FEDERALLY SPONSORED RESEARCH OR DEVELOPMENT

Not applicable.

BACKGROUND OF THE INVENTION

1. Field of the Invention

The present invention pertains to very wideband spiral antennas and, more particularly, to backlobe elimination in such spiral antennas in small, confined spaces.

2. Description of the Related Art

This section of this document introduces various aspects of the art that may be related to various aspects of the present invention described and/or claimed below. It provides background information to facilitate a better understanding of the various aspects of the present invention. As the section's title implies, this is a discussion of "related" art. That such art is related in no way implies that it is also "prior" art. The related art may or may not be prior art. The discussion in this section of this document is to be read in this light, and not as admissions of prior art.

One particular type of antenna is known as a planar "spiral antenna". Spiral antennas take their name from the spiral shape of their radiating/receiving elements. As with most antennas, the planar spiral antenna radiates or receives from all directions, but primarily from the front side and the back side, more commonly known at the "frontlobe" and the "backlobe". The backlobe is commonly undesirable, and the art has proposed a number of techniques for eliminating, or at least mitigating, such backlobes.

The classic technique absorbs the backlobe in a deep cavity (e.g., a depth that is twice the width of the antenna; for example, 3") filled with a honeycombed dielectric material. Another approach is disclosed in U.S. Pat. No. 6,407,721, which we have not seen reproduced in the laboratory. However, all of the techniques proposed by the art have drawbacks associated with their benefits. The art therefore continues to seek alternative backlobe elimination techniques in reduced volume space and by simple designs allowing low cost embodiments.

The present invention is directed to resolving, or at least reducing, one or all of the problems mentioned above.

SUMMARY OF THE INVENTION

In a first aspect, a spiral antenna, comprising a substrate; a spiral element formed upon the substrate; a ground plane behind the spiral element; and an array of electromagnetically conductive members disposed between and almost contacting the spiral element and the ground plane so as to bleed a backlobe of a signal away from the spiral element to the ground plane.

In a third aspect, the invention includes a method of eliminating a backlobe associated with a signal transmitted or received through a spiral antenna, comprising bleeding the backlobe of the signal away from a spiral element to a ground plane through a plurality of electromagnetically conductive conical elements disposed therebetween.

In a fourth aspect, the invention includes a spiral antenna, comprising: a spiral element; a ground plane behind the spiral element; and means for bleeding the backlobe of the signal away from the spiral element to the ground plane.

The above presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

BRIEF DESCRIPTION OF THE DRAWINGS

The invention may be understood by reference to the following description taken in conjunction with the accompanying drawings, in which like reference numerals identify like elements, and in which:

FIG. 1A-FIG. 1C illustrate one particular embodiment of a spiral antenna constructed and operated in accordance with several aspects of the present invention, in which FIG. 1A is an assembled, perspective view, FIG. 1B is the spiral antenna of FIG. 1A with the face removed, and FIG. 1C is partially sectioned, fragmented side view of the spiral antenna of FIG. 1A;

Figure 1A:
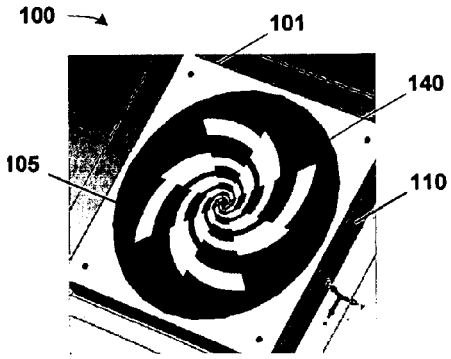

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

The present invention is directed to miniaturizing wideband multipolar antennas that have backlobe elimination. In the embodiments disclosed herein, the spiral antennas are deployed on midsized missiles, for example, those that are 5" diameter. On missiles of this size, it is difficult to package multiple wideband antennas due to surface area and depth limitations. The goal for this particular embodiment is to package multiple separate antennas circumferentially about the missile surface at the nose and as described herein. Each antenna's performance is very wideband (approximately 2 Ghz to 18 Ghz); left and right hand circular polarization sensitive; and horizontal ("H") H-H, vertical ("V")-V, and V-H sensitive. Each antenna's size is not more than 2.4" in diameter and 0.4" deep.

More particularly, a four (or eight) arm natural log growth spiral with members is used as the primary antenna with center feed. The side of the antenna (i.e., the backlobe) requiring rejection contains an array of three-dimensional ("3D") electrically conductive, geometrically shaped members approximately ⅜" tall. The geometric shape of the members in the illustrated embodiment is conical. The conical elements are "pointy" or "narrow" where it is is closest, or proximate, to the spiral element of the antenna—that is, the apex of the conical elements almost contacts the plane in which the spiral elements reside. The conical elements are "broad" or "spread" where they are furthest, or most distal, from the antenna—that is, the base of the conical elements contact the ground plane. This allows for a gradual spatial transition into a conductive zone where the back lobe waves are neutralized. In the illustrated embodiment, the members are arranged in a diamond-shaped array.

The present invention will now be described with reference to the attached figures. Various structures, systems and devices are schematically depicted in the drawings for purposes of explanation only and so as to not obscure the present invention with details that are well known to those skilled in the art. Nevertheless, the attached drawings are included to describe and explain illustrative examples of the present invention.

Figure 1B:
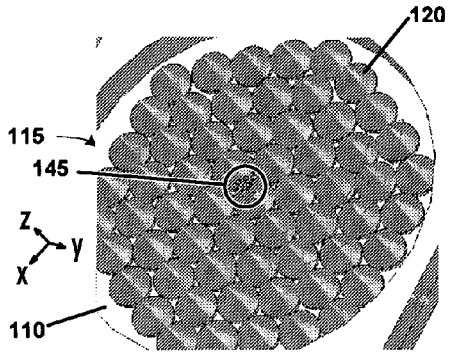
Figure 1C:
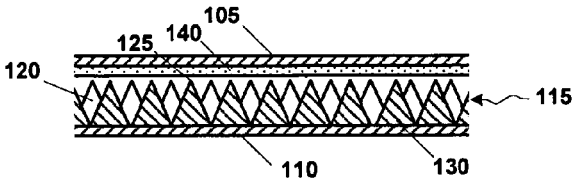

FIG. 1A-FIG. 1C illustrate one particular embodiment of a spiral antenna 100 constructed and operated in accordance with several aspects of the present invention. FIG. 1A is an assembled, perspective view of the spiral antenna 100. FIG. 1B is the spiral antenna 100 of FIG. 1A with the face 102 removed. FIG. 1C is partially sectioned, fragmented side view of the spriral antenna 100 illustrate certain structural and functional relationships described further below.

Referring now to FIG. 1A-FIG. 1C collectively, the spiral antenna comprises a spiral element 105, a ground plane 110 behind the spiral element 105, and an array 115 of electromagnetically conductive members 120 (only one indicated). The ground plane 110 is "behind" the spiral element 105 in the sense that it is positioned on the side opposite that in which the signal propagates in its intended direction. Stated alternatively, it is "behind" the spiral element 105 in the sense that it is positioned on the side of the spiral element 105 where the backlobe of any such signal will be found.

The members 120 are disposed between and almost contacting the spiral element 105 and the ground plane 110 so as to bleed a backlobe of a signal away from the spiral element 105 to the ground plane 110. In the illustrated embodiment, the array 115 of members 120 comprises a plurality of conical elements disposed between the spiral element 105 and the ground plane 120 such that the apexes 125 of the conical elements almost contact the spiral element 105 and the bases 130 of the conical elements contact the ground plane 110.

The conical form of the members 120 in the illustrated embodiment is desirable because they provide a pathway that channels the backlobe to the ground plane 110, thereby allowing it to dissipate, or "bleed" away, without short circuiting the spiral element 105 to the ground plane 110. Note, however, that the invention is not necessarily limited to the members 120 shown in the illustrated embodiment. These are, by way of example and illustration, but one means for bleeding a backlobe of a signal away from the spiral element to the ground plane. Other embodiments may alternatively employ equivalent structures performing that same function. For example, other embodiments may employ members that are spires, pyramids, needles, or are irregularly shaped.

In the illustrated embodiment, the array of the members 120 is arranged in a triangular, or a diamond, pattern. However, computer simulations have established that the technique will also work with lesser efficacy with other array patterns. Such other arrays may include, but are not limited to, circular, spiral (e.g., circular spiral, rose spiral), rectangular, square patterns.

Figure 2A:
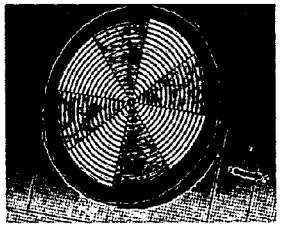
FIG. 2A-FIG. 2C depict spiral patterns alternative to that shown in FIG. 1 as may be used in some alternative embodiments.
Figure 2B:
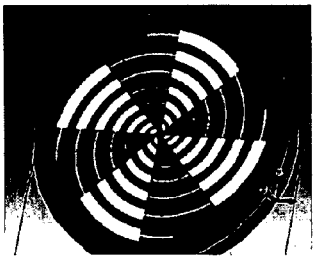
Figure 2C:
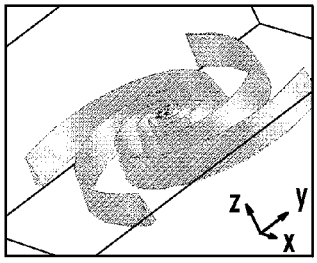

The spiral element 105 can similarly be implemented in alternative spiral designs. The design of the spiral element 105 illustrated in FIG. 1A-FIG. 1C is what is known as a "modulated arm width" as a "natural log growth" spiral since it embodies both those characteristics. Other suitable spiral designs include, but are not limited to, Archimedean (FIG. 2A), logarithmic (or, log base 10) (FIG. 2B), rose cone (FIG. 2C), cone, Mehen, single, hybrid, and natural spiral designs. The "Mehen" spiral design is the one disclosed in U.S. Pat. No. 6,407,721.

Techniques for designing and fabricating spiral elements such as the spiral element 105 are known to the art. For example, U.S. Pat. No. 6,407,721 provides details for both design and fabrication of a Mehen spiral element. Any suitable technique known to the art for any given spiral design that is desired may be employed. The present invention therefore admits wide variation in design and fabrication considerations such as materials selection. In the illustrated embodiment, the spiral element 105 is fabricated from a metal material such as a copper chase on a substrate of dielectric material 140 such as Kapton (a polyimide plastic).

The members 120 are, as noted above, electromagnetically conductive. They are therefore fabricated from a ferromagnetic metal such as Nickel, Aluminum, or Zinc, or some other electrically conductive material. They alternatively may be fabricated of a material that is not ferromagnetic so long as that material is electromagnetically conductive or they are coated in an electromagnetically conductive material.

In the illustrated embodiment, the ground plane 110 is fabricated in the shape of a flanged cup. The bowl of the cup design provides a convenient area in which to dispose the array 115 of members 120 and the flange provides a convenient point at which to fasten the facing 101 to enclose the bowl. The ground plane 110 is fabricated from a ferromagnetic metal whose selection can be governed by principles well known to those in the art. The ground plane 110 may be fabricated from the same material as the members 120.

The illustrated embodiment fabricates both the members 120 and the ground plane 110 from the same ferromagnetic material using a casting process. That is, the members 120 and the ground plane 110 are cast as a single piece. The members 120 and ground plane 110 may therefore, in this embodiment, be considered a single, particularly shaped, ground plane. However, this is not necessary to the practice of the invention. The members 120 and ground plane 110 may be assembled as separate pieces in some embodiments. Packaging considerations may also be of interest. For example, when the members 120 and the ground plane 110 are assembled as separate pieces, a packing dielectric material may be used to fill the ullage of the bowl in the cup of the ground plane 110. In the illustrated embodiment, the ullage is filled with ambient atmosphere.

The entire antenna may also, in some alternative embodiments, be manufactured to be conformal to a surface. This is a common practice in shallow depth antennas packaged on aircraft surfaces. Multiple configurations of producing the members with a spiral antenna element in a surface conformal profile are possible.

Those in the art having the benefit of this disclosure will appreciate that the spiral antenna may be used to transmit, receive, or both transmit and receive signals. To this end, the spiral antenna 100 includes access to a plurality of signal leads 145. In the illustrated embodiment, bores for four leads 145, one for each arm, brought in through the ground plane 110 and the central one of the members 120 and electrically connected to the backside of the arms of the spiral element 115. The leads 145 are implemented in micro-coaxial cables, but any suitable lead known to the art may be used. This will typically be an implementation specific detail depending on design constraints of the individual implementation.

Figure 3:
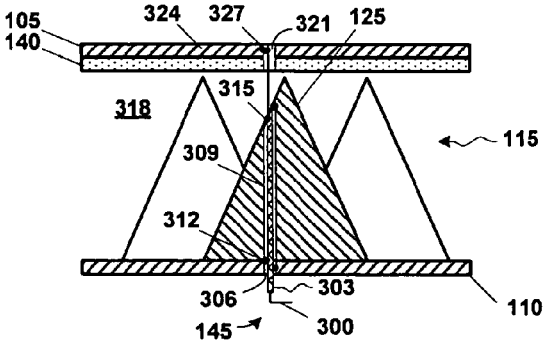
FIG. 3 depicts in a planar, cross-section the connections for signal leads in the embodiment illustrated in FIG. 1A-FIG. 1B.

The electrical connection of one lead 145 is more particularly shown in FIG. 3. As noted above, the lead 145 is a micro-coaxial cable. The lead 145 therefore comprises an inner conductor 300 electromagnetically shielded by an outer conductor 303, for which reason the outer conductor 303 is sometimes referred to as the "shield". The lead 145 is threaded through a via 306 in the grounding plane 110 and a bore 309 in the member 120. The outer conductor 303 is electromagnetically connected—e.g., soldered—to the ground plane at one or more points 312. It is similarly electromagnetically connected to the member 120 at one or more points 315. The inner conductor 300 extends through the bore 309 and the ullage 318, through a via 321 in the substrate 140, whereupon it is electromagnetically connected to one arm 324 of the spiral 105 at one or more points 327.

The embodiments illustrated herein disclose the present invention in the context of a missile application. The invention is not so limited. For example, the present invention may find applicability is many applications where a wideband, small size (e.g., 56 mm diameter) multi-polar synthetic aperture radar ("SAR") antenna is desirable. SAR antennas are used in, for example, protected communications, imaging, mapping, seeking, and still other uses. Those in the art having the benefit of this disclosure may appreciate still other applications for the present invention.

The presently disclosed technique therefore provides a low profile antenna with a simple, low cost means for bleeding the backlobe away into the ground plane without affecting the frontlobe. More particularly, the illustrated embodiments comprise a simple antenna system providing wideband coverage over multiple polarizations while eliminating the parasitic backlobe within a confined space at a low cost.

The phrase "capable of" as used herein is a recognition of the fact that some functions described for the various parts of the disclosed apparatus are performed only when the apparatus is powered and/or in operation. Those in the art having the benefit of this disclosure will appreciate that the embodiments illustrated herein include a number of electronic or electromechanical parts that, to operate, require electrical power. Even when provided with power, some functions described herein only occur when in operation. Thus, at times, some embodiments of the apparatus of the invention are "capable of" performing the recited functions even when they are not actually performing them—i.e., when there is no power or when they are powered but not in operation.

The following documents are hereby incorporated into this specification by reference as is set forth verbatim herein for purposes noted:

U.S. Pat. No. 6,407,721, entitled, "Super Thin, Cavity Free Spiral Antenna", issued Jun. 18, 2002, to Raytheon Company as assignee of the inventors Mike Mehen et al. for its teachings as comprising a part of the prior art, as well as its teachings regarding the design and fabrication of the spiral radiating element disclosed therein to the exclusion of the backlobe mitigation technique;

U.S. Pat. No. 5,990,849, entitled, "Compact Spiral Antenna", issued Nov. 23, 1999, to Raytheon Company as assignee of the inventors Gary Salvall et al. for its teachings as comprising a part of the prior art, as well as its teachings regarding the design and fabrication of the spiral radiating element disclosed therein to the exclusion of the backlobe mitigation technique;

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A spiral antenna, comprising:

a substrate;

a spiral element formed upon the substrate;

a ground plane behind the spiral element; and an array of electromagnetically conductive members disposed between the spiral element and the ground plane so as to bleed a backlobe of a signal away from the spiral element to the ground plane;

wherein each electromagnetically conductive member of the array of electromagnetically conductive members has an apex and a base that rests on the ground plane, wherein each base of a respective electromagnetically conductive member is in a same plane as every other base of the electromagnetically conductive members and is adjacent to at least one other base of an electromagnetically conductive member, and wherein each apex of the electromagnetically conductive members is a same distance from the ground plane.

2. The spiral antenna of claim 1, wherein the ground plane and the electromagnetically conductive members comprise a single piece.

3. The spiral antenna of claim 1, further comprising a plurality of signal lead corrections.

4. The spiral antenna of claim 1, further comprising:

a facing fabricated from a dielectric solid; and a cup mated to the facing and in which the array of electromagnetically conductive members is disposed.

5. The spiral antenna of claim 4, wherein the facing comprises the substrate and the cup comprises the ground plane.

6. The spiral antenna of claim 1, wherein the electromagnetically conductive members are packed in a dielectric material.

7. The spiral antenna of claim 1, wherein the array of electromagnetically conductive members is arranged in a diamond pattern array.

8. The spiral antenna of claim 1, further comprising a plurality of signal lead connections through one of the electromagnetically conductive members to the spiral antenna.

9. A method of eliminating a backlobe associated with a signal transmitted or received through a spiral antenna, comprising bleeding the antenna's backlobe away from the antenna element to a ground plane through a plurality of electromagnetically conductive conical elements disposed there between:

wherein each electromagnetically conductive conical element of the plurality of electromagnetically conductive conical elements has an apex and a base that rests on the ground plane, wherein each base of a respective electromagnetically conductive conical element is in a same plane as every other base of the electromagnetically conductive conical elements and is adjacent to at least one other base of an electromagnetically conductive conical element, and wherein each apex of the electromagnetically conductive conical elements is a same distance from the ground plane.

10. A spiral antenna, comprising:

a spiral element;

a ground plane behind the spiral element; and a plurality of electromagnetically conductive conical elements, each electromagnetically conductive conical element disposed between the spiral element and the ground plane and having an apex and a base that rests on the ground plane, wherein each base of a respective electromagnetically conductive conical element is in a same plane as every other base of the electromagnetically conductive conical elements and is adjacent to at least one other base of an electromagnetically conductive conical element, and wherein each apex of the electromagnetically conductive conical elements is a same distance from the ground plane.

* * * * *

UNITED STATES PATENT AND TRADEMARK OFFICE

CERTIFICATE OF CORRECTION

PATENT NO. : 8,749,451 B1
APPLICATION NO. : 12/932001
DATED : June 10, 2014
INVENTOR(S) : J. Michael Zamarron et al.

It is certified that error appears in the above-identified patent and that said Letters Patent is hereby corrected as shown below:

In the Claims;

Column 6, lines 54-55 in claim 3, replace:

"The spiral antenna of claim 1, further comprising a plurality of signal lead corrections." with --"The spiral antenna of claim 1, further comprising a plurality of signal lead connections."--.

Signed and Sealed this
Twenty-first Day of October, 2014

Michelle K. Lee

Michelle K. Lee
*Deputy Director of the United States Patent and Trademark Office*